US009102458B2

(12) United States Patent
Kuo et al.

(10) Patent No.: US 9,102,458 B2
(45) Date of Patent: Aug. 11, 2015

(54) PACKING DEVICE OF BACKLIGHT MODULE

(75) Inventors: Yicheng Kuo, Shenzhen (CN); Shihhsiang Chen, Shenzhen (CN); Gang Yu, Shenzhen (CN); Gege Zhou, Shenzhen (CN); Jiaqiang Wang, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 351 days.

(21) Appl. No.: 13/578,108

(22) PCT Filed: Jul. 9, 2012

(86) PCT No.: PCT/CN2012/078328

§ 371 (c)(1),
(2), (4) Date: Aug. 9, 2012

(87) PCT Pub. No.: WO2013/189106

PCT Pub. Date: Dec. 27, 2013

(65) Prior Publication Data

US 2013/0343069 A1 Dec. 26, 2013

(51) Int. Cl.
*B65D 81/02* (2006.01)
*B65D 85/30* (2006.01)
(Continued)

(52) U.S. Cl.
CPC ..... *B65D 81/05* (2013.01); *B65D 85/48* (2013.01)

(58) Field of Classification Search
CPC ..... A47G 29/00; B42F 7/10; B65D 81/07; G03C 3/00
USPC ..... 206/583, 521, 701, 703, 706, 707, 710, 206/586, 449, 453–455, 485, 1.5, 464; 362/396; 248/680, 681, 689, 692; 312/297, 298, 306, 223.1; 211/40, 211/41.1, 41.4, 41.12, 41.18
See application file for complete search history.

(56) References Cited

U.S. PATENT DOCUMENTS 4,630,737 A * 12/1986 King ..... 211/40
4,651,882 A * 3/1987 Wright et al. ..... 211/40
(Continued)

FOREIGN PATENT DOCUMENTS

CN 101097879 A 1/2008
CN 101863351 A 10/2010
(Continued)

OTHER PUBLICATIONS

Peng Zhihong, the International Searching Authority written comments, Jan. 2013, CN.

*Primary Examiner* — Luan K Bui
*Assistant Examiner* — Rafael Ortiz
(74) *Attorney, Agent, or Firm* — IPro, Inc.; Na Xu

(57) ABSTRACT

The present disclosure belongs to the field of liquid crystal displays (LCDs), and more particularly relates to a packing device of a backlight module including a fixing frame, a rotating shaft, and a clamping piece which can rotate around the rotating shaft. The rotating shaft is fixed to the fixing frame. The clamping piece includes an upper arm and a lower arm, and the upper arm and the lower arm are respectively used for clamping upper and lower surfaces of the backlight module. When an opening formed by surrounding the upper arm and the lower arm is upward, one edge of the backlight module can be put above the lower arm. Then, the backlight module is slowly put down, and the lower arm of the clamping piece rotates around the fixing shaft under stress. When the opening formed by surrounding the upper arm and the lower arm of the clamping piece is in a horizontal direction, the lower arm comes into contact with the lower surface of the backlight module to form a supporting state, and the upper arm of the clamping piece is pressed against the upper surface of the backlight module. Thus, the backlight module is completely fixed. The packing device of the backlight module of the present disclosure can be up and down stacked, and the stress of each layer of backlight module is uniform. Thus, a problem of affecting optical quality of the backlight module due to gravity accumulation is solved.

8 Claims, 3 Drawing Sheets

(51) Int. Cl.
*B65D 81/05* (2006.01)
*B65D 85/48* (2006.01)

(56) References Cited

U.S. PATENT DOCUMENTS

| | | | | |
|---|---|---|---|---|
| 5,201,414 | A * | 4/1993 | Kaszubinski | 206/308.1 |
| 5,842,567 | A * | 12/1998 | Rowe et al. | 206/364 |
| 6,073,764 | A * | 6/2000 | Haas et al. | 206/308.1 |
| 6,533,128 | B1 * | 3/2003 | Beneway | 211/40 |
| 6,969,132 | B1 * | 11/2005 | Viville | 312/306 |
| 2005/0045646 | A1 | 3/2005 | White, Jr. | |
| 2007/0145231 | A1 * | 6/2007 | Chen et al. | 248/689 |
| 2011/0192746 | A1 * | 8/2011 | Chang | 206/379 |
| 2011/0240830 | A1 * | 10/2011 | Alemozafar et al. | 248/689 |
| 2013/0119227 | A1 * | 5/2013 | Lin | 248/689 |

FOREIGN PATENT DOCUMENTS

| | | | |
|---|---|---|---|
| CN | 101992901 | A | 3/2011 |
| CN | 102085950 | A | 6/2011 |
| CN | 102157811 | A | 8/2011 |
| CN | 201923509 | A | 8/2011 |
| CN | 201923509 | U | 8/2011 |
| DE | 102011113143 | A1 | 3/2012 |
| JP | H0940019 | A | 2/1997 |
| JP | 2003-137287 | A | 5/2003 |

* cited by examiner

PACKING DEVICE OF BACKLIGHT MODULE

TECHNICAL FIELD

The present disclosure relates to the field of liquid crystal displays (LCDs), and more particularly to a packing device of a backlight module.

BACKGROUND

A typical liquid crystal display (LCD) device generally includes a front frame, an LCD panel, a middle frame, a light guide panel, a backplane and the like. The light guide panel is accompanied by an optical film. The front frame, the middle frame, and the backplane have different functions. The front frame is mainly used for fixing the LCD panel and preventing the LCD panel from jumping. The backplane is mainly used for carrying the optical film, the light guide panel, light bars and the like. The middle frame, together with the backplane, is mainly used for fixing optical components of the light guide panel, the optical film and the like, and simultaneously carrying the LCD panel. The backplane, the middle frame, and the light guide panel, the optical film and the light bars which are fixed by the backplane and the middle frame form a backlight module.

In the prior art, the backlight module is generally packed by a blister tray for achieving function of quakeproof protection. The blister tray has limited strength, and is not suitable for up and down stacking in large amount. Otherwise, it is easy to affect optical quality of the backlight module. Thus, someone uses a scheme of vertically putting the backlight module, but because the backlight module is a semi-finished product, the light guide panel and the optical film in the backlight module are not completely fixed, and the light guide panel is only fixed and limited by the middle frame. Because of factors of assembly and part tolerances, sometimes a pressing force of the middle frame acting on the light guide panel is insufficient; thus, in transportation process of the backlight module, the light guide panel may move up and down and even incline, affecting the optical quality. Or, if a structure of the LCD device is expected to be simplified and the middle frame is not arranged in the backlight module or the arranged middle frame does not have the function of fixing the light guide panel, it is difficult to fix the light guide panel in the transportation process. The backlight module is not suitable for being vertically put. A typical main packing mode is to put horizontally. The technical problem of affecting the optical quality when a great number of backlight modules are up and down stacked shall be solved.

SUMMARY

In view of the above-described problems, the aim of the present disclosure is to provide a packing device suitable for up and down stacking backlight modules.

The technical scheme of the present disclosure is that: a packing device of a backlight module comprises a fixing frame, a rotating shaft, and a clamping piece which can rotate around the rotating shaft. The rotating shaft is fixed to the fixing frame. The clamping piece comprises an upper arm and a lower arm, and the upper arm and the lower arm are respectively used for clamping upper and lower surfaces of the backlight module. The upper arm of the clamping piece has a shape of a straight line, and the lower arm has an L shape. The upper arm and the lower arm form a C-shaped structure. The rotating shaft is arranged on A joint of the upper arm and the lower arm. The fixing frame is configured with a first groove, and the upper arm of the clamping piece is correspondingly configured with a bulge. The bulge is clamped into the first groove to fix the upper arm of the clamping piece to the fixing frame. Or, the fixing frame is configured with a first bulge, t and he upper arm of the clamping piece is correspondingly configured with a groove. The first bulge is clamped into the groove to fix the upper arm of the clamping piece to the fixing frame. A cross section of the fixing frame is a C-shaped structure. The first groove or the first bulge is arranged on inner surfaces of two mutual parallel side walls of the fixing frame, and the bulge or the groove on the upper arm of the clamping piece is arranged on two side surfaces of the upper arm. The fixing frame is configured with a second groove, and the lower arm of the clamping piece is correspondingly configured with a bulge. The bulge is clamped into the second groove to fix the lower arm of the clamping piece to the fixing frame. Or, the fixing frame is configured with a second bulge, and the lower arm of the clamping piece is correspondingly configured with a groove. The second bulge is clamped into the groove to fix the lower arm of the clamping piece to the fixing frame. The second groove or the second bulge is arranged on inner surfaces of two mutual parallel side walls of the fixing frame. The bulge or the groove on the lower arm of the clamping piece is arranged on two side surfaces of the lower arm, and the upper and lower end surfaces of the fixing frame are both planes.

Another technical scheme of the present disclosure is that: a packing device of a backlight module comprises a fixing frame, a rotating shaft, and a clamping piece which can rotate around the rotating shaft. The rotating shaft is fixed to the fixing frame. The clamping piece comprises an upper arm and a lower arm, and the upper arm and the lower arm are respectively used for clamping upper and lower surfaces of the backlight module.

In one example, the upper arm of the clamping piece has a shape of a straight line, and the lower arm has an L shape, the upper arm and the lower arm form a C-shaped structure, and the rotating shaft is arranged on a joint of the upper arm and the lower arm.

In one example, the fixing frame is configured with a first groove, and the upper arm of the clamping piece is correspondingly configured with a bulge. The bulge is clamped into the first groove to fix the upper arm of the clamping piece to the fixing frame. Or the fixing frame is configured with a first bulge, and the upper arm of the clamping piece is correspondingly configured with a groove. The first bulge is clamped into the groove to fix the upper arm of the clamping piece to the fixing frame. When the bulge is clamped into the first groove, the fixing frame and the clamping piece are relatively fixed. When the bulge is released from the groove by force, the clamping piece can rotate around the rotating shaft. This structure is convenient to position the clamping piece. Thus, the packing of the backlight module is convenient, and packing efficiency is enhanced.

In one example, the cross section of the fixing frame is a C-shaped structure. The first groove or the first bulge is arranged on inner surfaces of two mutual parallel side walls of the fixing frame. The bulge or the groove on the upper arm of the clamping piece is arranged on two side surfaces of the upper arm.

In one example, the fixing frame is configured with a second groove, and the lower arm of the clamping piece is correspondingly configured with a bulge. The bulge is clamped into the second groove to fix the lower arm of the clamping piece to the fixing frame. Or the fixing frame is configured with a second bulge, and the lower arm of the clamping piece is correspondingly configured with a groove. The second bulge is clamped into the groove to fix the lower arm of the clamping piece to the fixing frame. This structure is convenient to position the clamping piece. Thus, the packing of the backlight module is convenient, and the packing efficiency is enhanced.

In one example, the cross section of the fixing frame is a C-shaped structure, and the second groove or the second bulge is arranged on inner surfaces of two mutual parallel side walls of the fixing frame. The bulge or the groove on the lower arm of the clamping piece is arranged on two side surfaces of the lower arm.

Preferably, the upper and the lower end surfaces of the fixing frame are both planes, which are convenient to up and down stack the fixing frame.

In one example, the packing device comprises an outer box. The fixing frame is put inside the outer box. The fixing frame and the clamping piece are four in number and divided into two rows, which are respectively used for clamping two parallel edges of the backlight module. Lengths of the fixing frames and the clamping pieces are short, and a large spacing is arranged between two rows of fixing frames. Thus, material cost is low.

In one example, the packing device comprises an outer box, and the fixing frame is put inside the outer box. The fixing frame and clamping piece are two in number, which are respectively used for clamping two parallel edges of the backlight module.

In one example, the length of the clamping piece is longer than the length of the parallel edges of the backlight module. Two ends of the clamping piece are also configured with spacing structures for preventing the backlight module from moving. The spacing structures are stop blocks which are integrally formed with the clamping piece.

The present disclosure has the advantages that: in the present disclosure, a typical packing mode by the blister tray is not adopted, but a packing device of a backlight module is designed. The clamping piece comprises an upper arm and a lower arm, and the upper arm and the lower arm are respectively used for clamping the upper and lower surfaces of the backlight module. The clamping piece can rotate around the rotating shaft on the fixing frame. When an opening formed by surrounding the upper arm and the lower arm is upward or inclines upwards, one edge of the backlight module can be put above the lower arm Then, the backlight module is slowly put down, and the lower arm of the clamping piece rotates around the fixing shaft under stress. When the opening formed by surrounding the upper arm and the lower arm of the clamping piece is in a horizontal direction, the lower arm comes into contact with the lower surface of the backlight module to form a supporting state, and he upper arm of the clamping piece is pressed against the upper surface of the backlight module. At this moment, the clamping piece cannot rotate continuously. Thus, the backlight module is completely fixed. The packing device of the backlight module of the present disclosure can be up and down stacked, the gravity of the upper backlight module is absorbed by the fixing frame, and the stress of each layer of backlight module is uniform. Thus, a problem of affecting the optical quality of the backlight module due to gravity accumulation is solved.

A part of backlight module adopts a sectional type middle frame. If the fixing force of the middle frame acting on the optical film and the light guide panel is insufficient, the risk may be increased in the process of packing and transporting the backlight module. The upper arm of the clamping piece of the packing device of the present disclosure can press the middle frame of the backlight module. Thus, displacement of the optical film and the light guide panel is effectively prevented, and the transportation safety is ensured.

Figure 1:
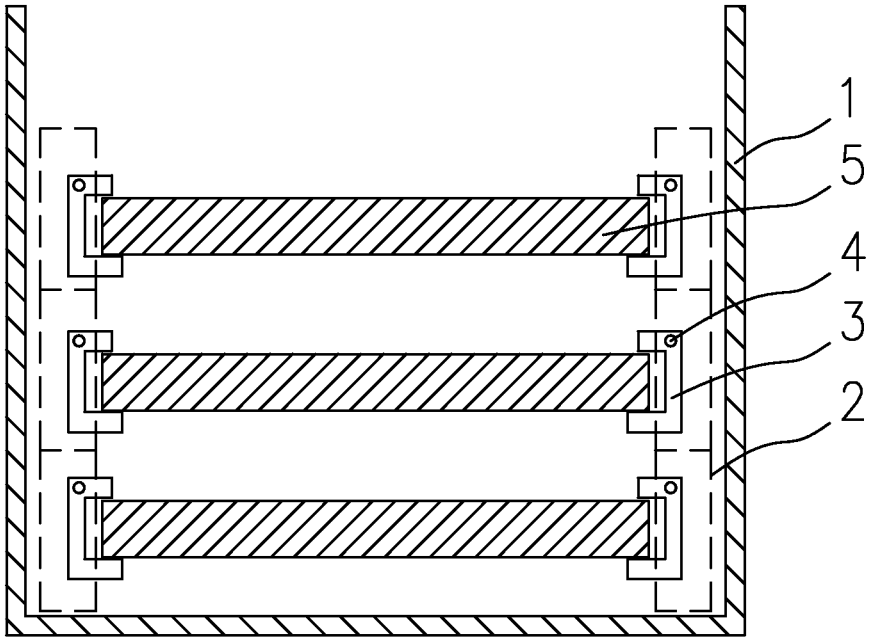
FIG. 1 is a structural diagram of a packing device of a backlight module of an example of the present disclosure.
Figure 2:
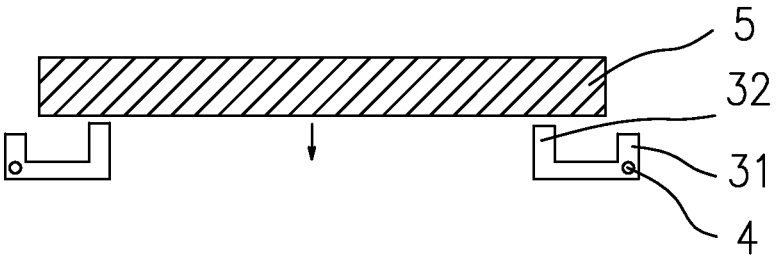
FIG. 2 is a position diagram of a clamping piece and a backlight module before putting a backlight module into a packing device of the present disclosure.
Figure 3:
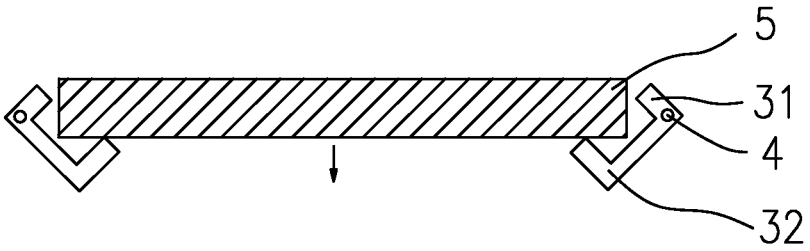
FIG. 3 is a position diagram of a clamping piece and a backlight module in the process of putting a backlight module into a packing device of the present disclosure.
Figure 4:
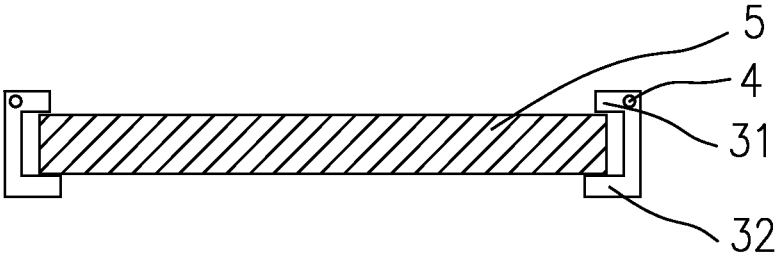
FIG. 4 is a position diagram of a clamping piece and a backlight module after putting a backlight module into a packing device of the present disclosure.

Legends: 1. outer box; 2. fixing frame; 21. first groove; 22. second groove; 3. clamping piece; 31. upper arm; 311. bulge; 32. lower arm; 321. bulge; 4. rotating shaft; 5. backlight module; 51. middle frame; 52. backplane; 53. optical film and light guide panel.

DETAILED DESCRIPTION

The present disclosure discloses a packing device of a backlight module. As shown in FIG. 1 to FIG. 5, the packing device comprises a fixing frame 2, a rotating shaft 4, and a clamping piece 3 which can rotate around the rotating shaft 4; the rotating shaft 4 is fixed to the fixing frame 2. The clamping piece 3 comprises an upper arm 31 and a lower arm 32, and the upper arm 31 and the lower arm 32 are respectively used for clamping upper and lower surfaces of the backlight module 5.

In the example, the packing device also comprises an outer box 1. The fixing frame 2 is put inside the outer box 1. The fixing frame 2 and clamping piece 3 are four in number and divided into two rows and respectively used for clamping two parallel edges of the backlight module 5. The upper arm 31 of the clamping piece 3 has a shape of a straight line, and the lower arm 32 has an L shape. The upper arm 31 and the lower arm 32 form a C-shaped structure. The rotating shaft 4 is arranged on a joint of the upper arm 31 and the lower arm 32.

In the present disclosure, a typical packing mode by a blister tray is not adopted, but a packing device of a backlight module is designed. The clamping piece 3 comprises an upper arm 31 and a lower arm 32. The upper arm 31 and the lower arm 32 are respectively used for clamping the upper and lower surfaces of the backlight module 5. The clamping piece 3 can rotate around the rotating shaft 4 on the fixing frame. When an opening formed by surrounding the upper arm 31 and the lower arm 32 is upward or inclines upwards, one edge of the backlight module 5 can be put above the lower arm 32. Then, the backlight module 5 is slowly put down, and the lower arm 32 of the clamping piece rotates around the fixing shaft 4 under stress. When the opening formed by surrounding the upper arm and the lower arm of the clamping piece 3 is in a horizontal direction, the lower arm 32 comes into contact with the lower surface of the backlight module 5 to form a supporting state. The upper arm 31 of the clamping piece is pressed against the upper surface of the backlight module 5. At this moment, the clamping piece 3 cannot rotate continuously. Thus, the backlight module is completely fixed. The packing device of the backlight module of the present disclosure can be up and down stacked, gravity of the upper backlight module is absorbed by the fixing frame, and the stress of each layer of backlight module is uniform. Thus, a problem of affecting the optical quality of the backlight module due to gravity accumulation is solved.

In the example, lengths of the fixing frames and the clamping pieces are short, and a large spacing is arranged between two rows of fixing frames. Thus, material cost is low. Optionally, more than three fixing frames and clamping pieces can also be arranged in the same row according to the length of the backlight module.

Figure 6:
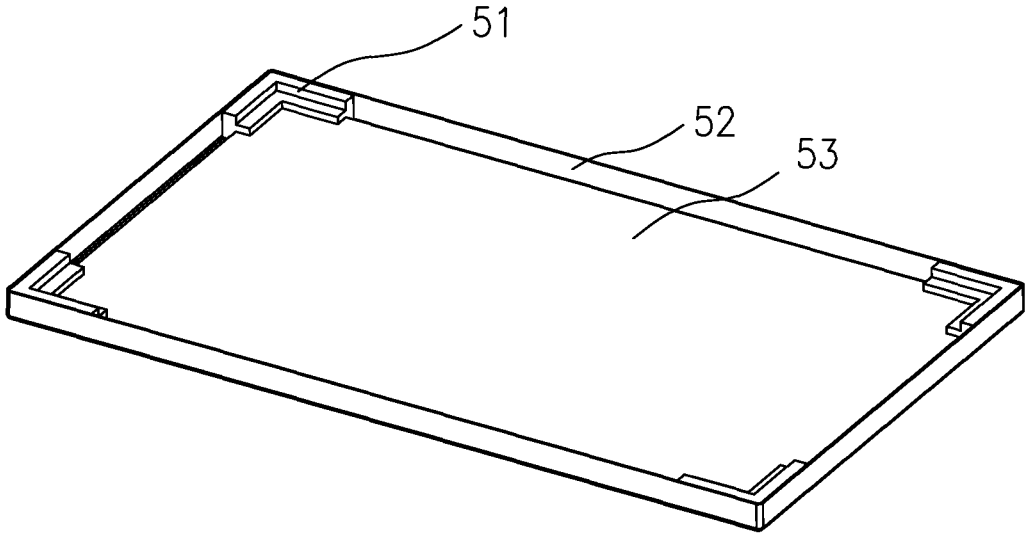
FIG. 6 is a schematic diagram of a backlight module of adopting a sectional type middle frame.

A part of backlight module adopts a sectional type middle frame. As shown in FIG. 6, the optical film and the light guide panel 53 are both clamped between the middle frame 51 and the backplane 52 If a fixing force of the middle frame 51 acting on the optical film and the light guide panel 53 is insufficient, the risk may be increased in the process of packing and transporting the backlight module. The upper arm of the clamping piece of the packing device of the present disclosure can press the middle frame of the backlight module. Thus, displacement of the optical film and the light guide panel is effectively prevented, and the transportation safety is ensured.

Figure 5:
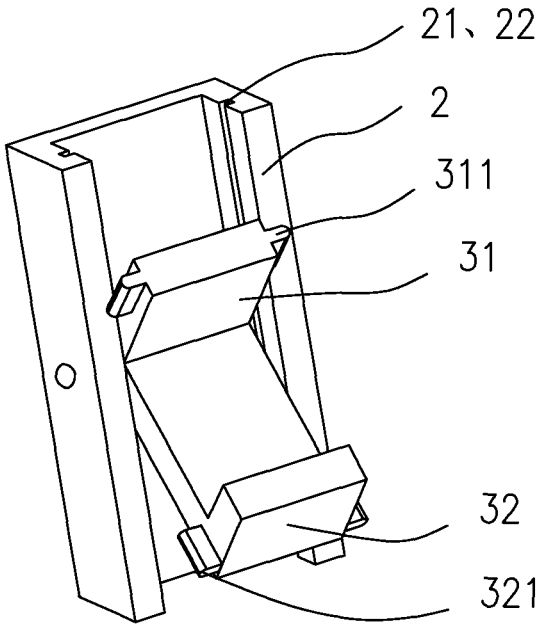
FIG. 5 is a spatial structure diagram of a fixing frame and a clamping piece of the present disclosure.

In the example, as shown in FIG. 5, the fixing frame 2 is configured with a first groove 21, and the upper arm 31 of the clamping piece is correspondingly configured with a bulge 311. The bulge 311 is clamped into the first groove 21 to fix the upper arm 31 of the clamping piece to the fixing frame 2. The cross section of the fixing frame 2 is a C-shaped structure. The first groove 21 is arranged on the inner surfaces of two mutual parallel side walls of the fixing frame 2, and the bulge 311 on the upper arm 31 of the clamping piece is arranged on two side surfaces of the upper arm. The matching structure of the first groove and the bulge can be used for relatively fixing the fixing frame and the clamping piece. When the bulge is clamped into the groove, the fixing frame and the clamping piece are relatively fixed. When the bulge is released from the groove by force, the clamping piece can rotate around the rotating shaft. This structure is convenient for positioning the clamping piece. Thus, the packing of the backlight module is convenient, and the packing efficiency is enhanced. Because the bulge is clamped into the groove during packing, the clamping piece cannot freely rotate. At this moment, the backlight module can also be vertically put and transported.

In the example, the fixing frame 2 is configured with a second groove 22, and the lower arm 32 of the clamping piece is correspondingly configured with a bulge 321. The bulge 321 is clamped into the second groove 22 to fix the lower arm 32 of the clamping piece to the fixing frame 2. The second groove 22 is arranged on the inner surfaces of two mutual parallel side walls of the fixing frame 2, and the bulge 321 on the lower arm 32 of the clamping piece is arranged on two side surfaces of the lower arm. The purpose of arranging the second groove and the second bulge is consistent with the purpose of arranging the first groove and the first bulge. In the example, because the first groove 311 and the second groove 321 are communicated, they are the same groove.

In the example, the upper and the lower end surfaces of the fixing frame 2 are both planes, which are convenient for up and down stacking the fixing frame 2. Optionally, it is also feasible to adopt other corresponding contact surfaces.

In the aforementioned example, the positions of the groove on the fixing frame and the bulge on the clamping piece can be exchanged. The same advantages can be achieved: the fixing frame is configured with a first bulge, and the upper arm of the clamping piece is correspondingly configured with a groove. The first bulge is clamped into the groove to fix the upper arm of the clamping piece to the fixing frame. The fixing frame is configured with a second bulge, and he lower arm of the clamping piece is correspondingly configured with a groove. The second bulge is clamped into the groove to fix the lower arm of the clamping piece to the fixing frame.

In another example, the packing device comprises an outer box. The fixing frames are put inside the outer box, and the fixing frame and clamping piece are two in number and respectively used for clamping two parallel edges of the backlight module. The length of the clamping piece is longer than the length of the parallel edges of the backlight module. Two ends of the clamping piece are also configured with spacing structures for preventing the backlight module from moving, and the spacing structures are stop blocks which are integrally formed with the clamping piece.

The inner wall of the outer box can also be configured with a slot used for accommodating the fixing frame for better fixing the backlight module.

In the example, the lengths of the fixing frame and the clamping piece are long; the material cost is high. But the advantages as described in the first example can also be achieved. The spacing structures in the example can also be applied to the first example and can also perform the function of preventing the backlight module from moving.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A packing device of a backlight module, comprising:

a fixing frame, a rotating shaft fixed to the fixing frame, and a clamping piece which can rotate around the rotating shaft;

wherein the clamping piece comprises an upper arm and a lower arm, and the upper arm and the lower arm are respectively used for clamping upper and lower surfaces of the backlight module;

wherein the upper arm of the clamping piece has a shape of a straight line the lower arm has an L shape, and the upper arm and the lower arm form a C-shaped structure;

wherein the rotating shaft is arranged on a joint of the upper arm and the lower arm;

wherein the fixing frame is configured with a first groove, the upper arm of the clamping piece is correspondingly configured with a bulge, and the bulge is clamped into the first groove to fix the upper arm of the clamping piece to the fixing frame; or, the fixing frame is configured with a first bulge, the upper arm of the clamping piece is correspondingly configured with a groove, and the first bulge is clamped into the groove to fix the upper arm of the clamping piece to the fixing frame; a cross section of the fixing frame is a C-shaped structure;

wherein the first groove or the first bulge is arranged on inner surfaces of two mutual parallel side walls of the fixing frame; the bulge or the groove on the upper arm of the clamping piece is arranged on two side surfaces of the upper arm;

wherein the fixing frame is configured with a second groove, the lower arm of the clamping piece is correspondingly configured with a bulge, and the bulge is clamped into the second groove to fix the lower arm of the clamping piece to the fixing frame; or the fixing frame is configured with a second bulge, the lower arm of the clamping piece is correspondingly configured with a groove, and the second bulge is clamped into the groove to fix the lower arm of the clamping piece to the fixing frame; and wherein the second groove or the second bulge is arranged on inner surfaces of two mutual parallel side walls of the fixing frame; the bulge or the groove on the lower arm of the clamping piece is arranged on two side surfaces of the lower arm; the upper and lower end surfaces of the fixing frame are planes.

2. A packing device of a backlight module, comprising:

a fixing frame, a rotating shaft fixed to the fixing frame, and a clamping piece which can rotate around the rotating shaft;

wherein the clamping piece comprises an upper arm along a horizontal direction and a lower arm, and the upper arm and the lower arm are respectively used for clamping upper and lower surfaces of a backlight module, wherein the upper arm of the clamping piece has a shape of a straight line, the lower arm has an L shape, and the upper arm and the lower arm form a C-shaped structure; the rotating shaft is arranged on a joint of the upper arm and the lower arm, wherein the fixing frame is configured with a first groove, the upper arm of the clamping piece is correspondingly configured with a bulge, and the bulge is clamped into the first groove to fix the upper arm of the clamping piece to the fixing frame; or the fixing frame is configured with a first bulge, the upper arm of the clamping piece is correspondingly configured with a groove, and the first bulge is clamped into the groove to fix the upper arm of the clamping piece to the fixing frame, wherein a cross section of the fixing frame is a C-shaped structure; the first groove or the first bulge is arranged on inner surfaces of two mutual parallel side walls of the fixing frame; the bulge or the groove on the upper arm of the clamping piece is arranged on two side surfaces of the upper arm.

3. The packing device of the backlight module of claim 2, wherein the fixing frame is configured with a second groove, the lower arm of the clamping piece is correspondingly configured with a bulge, and the bulge is clamped into the second groove to fix the lower arm of the clamping piece to the fixing frame; or the fixing frame is configured with a second bulge, the lower arm of the clamping piece is correspondingly configured with a groove, and the second bulge is clamped into the groove to fix the lower arm of the clamping piece to the fixing frame.

4. The packing device of the backlight module of claim 3, wherein a cross section of the fixing frame is a C-shaped structure; the second groove or the second bulge is arranged on inner surfaces of two mutual parallel side walls of the fixing frame, and the bulge or the groove on the lower arm of the clamping piece is arranged on two side surfaces of the lower arm.

5. The packing device of the backlight module of claim 2, wherein upper and lower end surfaces of the fixing frame are planes.

6. The packing device of the backlight module of claim 2, wherein the packing device also comprises an outer box; the fixing frame is put inside the outer box; the fixing frame and clamping piece are four in number, and the four fixing frames and the clamping pieces are divided into two rows and are respectively used for clamping two parallel edges of the backlight module.

7. The packing device of the backlight module of claim 2, wherein the packing device also comprises an outer box; the fixing frame is put inside the outer box; the fixing frame and clamping piece are two in number, and the two fixing frames and the clamping pieces are respectively used for clamping two parallel edges of the backlight module.

8. The packing device of the backlight module of claim 7, wherein two ends of the clamping pieces are also configured with spacing structures for preventing the backlight module from moving.

* * * * *